United States Patent [19]

Kohyama

[11] Patent Number: 4,935,782

[45] Date of Patent: Jun. 19, 1990

[54] IMAGE FORMING APPARATUS USING A DEVELOPER INCLUDING INVISIBLE AND COLORED PARTICLES

[75] Inventor: Mitsuaki Kohyama, Higashikurume, Japan

[73] Assignee: Kabushiki Kaisha Toshiba, Kawasaki, Japan

[21] Appl. No.: 167,127

[22] Filed: Mar. 11, 1988

[30] Foreign Application Priority Data

Mar. 26, 1987 [JP] Japan ..... 62-72126

[51] Int. Cl.[5] ..... G03G 15/00; G03G 9/00

[52] U.S. Cl. ..... 355/245; 355/266; 430/110; 430/111

[58] Field of Search ..... 430/42, 45, 54, 97, 430/105, 100, 107–110; 355/3 DD, 4, 14 D, 245, 266, 267; 118/644, 645, 653

[56] References Cited

U.S. PATENT DOCUMENTS

| | | | |
|---|---|---|---|
| 3,013,890 | 12/1961 | Bixby | 430/45 |
| 3,910,698 | 8/1975 | Fukushima et al. | 430/100 |
| 4,078,929 | 3/1978 | Gundlach | 430/42 |
| 4,611,901 | 9/1986 | Kohyama et al. | 355/4 |
| 4,623,605 | 11/1986 | Kato et al. | 430/110 |

FOREIGN PATENT DOCUMENTS

| | | | |
|---|---|---|---|
| 56-87061 | 7/1981 | Japan | 430/45 |
| 56-91252 | 7/1981 | Japan | 118/645 |
| 58-132256 | 8/1983 | Japan | 355/4 |
| 59-124354 | 7/1984 | Japan | 355/4 |

*Primary Examiner*—R. L. Moses
*Assistant Examiner*—E. Pipala
*Attorney, Agent, or Firm*—Foley & Lardner, Schwartz, Jeffery, Schwaab, Mack, Blumenthal & Evans

[57] ABSTRACT

An image forming apparatus including a first image forming unit for forming a first electrostatic latent image having two distinct portions on an image carrier, a first developing unit for developing the first electrostatic latent image into a first visible image on the image carrier, a charging unit for charging the image carrier with the first visible image thereon, a second image forming unit for forming a second electrostatic latent image on the image carrier, a second developing unit for developing the second electrostatic latent image into a second visible image on the image carrier, and a transferring unit for transferring the first and second visible images from the image carrier onto an image bearing medium. In the image forming apparatus, the first developing unit contains a developer including colored particles and additive particles, the additive particles having a color substantially the same as the image bearing medium or being substantially colorless and transparent, and a bias voltage applied across the first developing unit and the image carrier for transferring the colored particles onto one of the two distinct portions of the first electrostatic latent image and the additive particles onto the other of the two distinct portions of the first electrostatic latent image.

9 Claims, 4 Drawing Sheets

IMAGE FORMING APPARATUS USING A DEVELOPER INCLUDING INVISIBLE AND COLORED PARTICLES

BACKGROUND OF THE INVENTION

1. Field of the Invention

The present invention relates to an image forming apparatus. In particular, the invention relates to an electrophotographic image forming apparatus wherein two-color images are transferred onto an image bearing medium from an image carrier after successive development of the two electrostatic latent images on the image carrier with various color developers.

2. Discussion of Background

In this type of image forming apparatus, a first electrostatic latent image is formed by a laser beam on a photosensitive body as an image carrier and this first latent image is converted into a visible color image with a first color developer. Then, a second electrostatic latent image is formed by a second laser beam and this second latent image is converted into a visible color image with a second color developer. The visible images of the two colors are transferred at the same time onto a sheet.

A "Two-color printing laser beam printer" was disclosed by Hoshi et al. in the Gazo Denshi Gakkai-shi (Image Electronics Institute Journal) Vol. 13, No. 14 (1984). In the laser beam printer in the above disclosure, two-color images are obtained by reversal development using a known two-component developing process. However, this involves a problem, since a second latent image is formed without making the potential distribution of the first developed latent image uniform, and image portions of the first latent image become further developed by the second color developer at the second developing stage.

As against this, it has been made clear in the Journal of Imaging Technology, Volume 12, No.2, 1986: "Two-Color Recording Process for Electrophotographic Printer" (J. Nakajima et al.) that the above problem can be resolved by including an additional stage. In the additional stage, the potential distribution of the first latent image is made uniform by using a known scorotron charger between the first developing stage and the second developing stage. However, even when this is done, there is still a problem in that a portion of the first toner image that has been formed beforehand on the photosensitive body is wiped off in the second devlopping stage, and toner of the first color contaminates the second developing unit, since the second development is effected by a contact developing method using magnetic toner.

In the Journal of Imaging Technology, Volume 12, No. 1, 1986: "High-Speed Color Laser Printing Process" (M. Kohyama et al.), the above problem is resolved by using non-contact development for the second development. This process makes it possible to completely avoid admixture of toner of different colors, whether on the photosensitive body or in developing units. However, the following problems remain.

The drawbacks of the prior art will be explained with reference to FIGS. 1 to 3. To obtain a first visible image on a photosensitive body 2 with a reversal development method, positively charged toner 3 of a first color adheres to image portions A on photosensitive body 2 on which a first positive electrostatic latent image has been formed. However, the tone inevitably includes particles having opposite polarity. Thus, this negatively charged toner 4 adheres to non-image portions B of the first latent image, as shown in FIG. 1. Then, photosensitive body 2 is charged by a charger 6 before forming of a second electrostatic latent image on photosensitive body 2. When this is done, negatively charged toner 4 also becomes charged, as shown in FIG. 2. After charging, the second electrostatic latent image is formed on the surface of photosensitive body 2. Then, toner of a second color (not shown) is adhered to the image portion on photosensitive body 2 with a reversal development method to obtain a second visible image on photosensitive body 2.

After development, the first and second visible images are transferred onto a sheet 5 by charging the sheet 5 with a negative polarity opposite to the positive polarity of toner 3. Thus causes electrostatic adhesion of positively charged toner 3, as shown in FIG. 3.

Since negative toner 4 also becomes positively charged by charger 6, negative toner 4 is also transferred onto sheet 5 with positive toner 3. As a result, background fogging undesirably occurs on the sheet after transfer of the first and second visible images onto the sheet.

In other words, there is a problem in that it is not possible to produce clear images with a conventional multi-color electrostatic recording apparatus.

SUMMARY OF THE INVENTION

It is an object of the present invention to provide an image forming apparatus which can obtain a clear multi-color image on an image bearing medium.

According to one aspect of the present invention, there is provided an improved image froming apparatus comprising means for forming a first electrostatic latent image having two distinct portions on an image carrier, means for developing the first electrostatic latent image into a first visible image on the image carrier, means for charging the image carrier with the first visible image theereon, means for forming a second electrostatic latent image on the image carrier, means for developing the second electrostatic latent image into a second visible image on the image carrier, and means for transferring the first and second visible images from the image carrier onto an image bearing medium, wherein the first developing means includes a developer including colored particles and additive particles, the additive particles having a color substantially the same as the image bearing medium or being substantially colorless and transparent, and electric field generating means for transferring the colored particles onto one of the two distinct portions of the first electrostatic latent image and the additive particles onto the other of the two distinct portions of the first electrostatic latent image.

It is preferred that the colored particles have a prescribed polarity, and the additive particles have a polarity opposite to the prescribed polarity of the colored particles for separating the additive particles from the colored particles under the action of the electric field generating means.

BRIEF DESCRIPTION OF THE DRAWINGS

These and other objects and advantages of this invention will become more apparent and more readily appreciated from the following detailed description of the presently preferred exemplary embodiments, taken in conjunction with the accompanying drawings of which.

DETAILED DESCRIPTION OF THE PREFERRED EMBODIMENTS

The following is a detailed deacription of an embodiment of the present invention with reference to the drawings.

Figure 1:
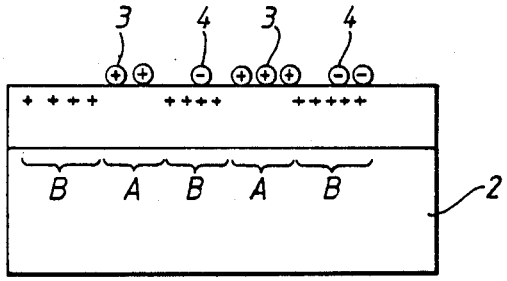
FIG. 1. PRIOR ART
FIG. 1 to 3 are transitional schematic views of the image forming process of the image forming apparatus in a prior art.
Figure 2:
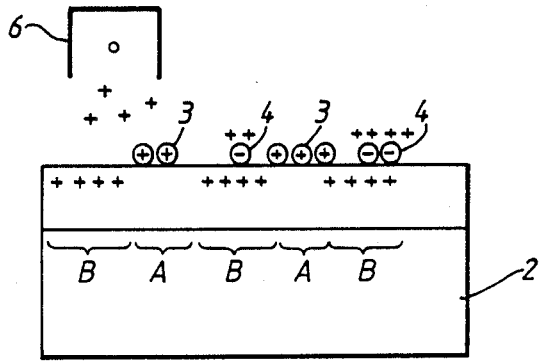
FIG. 2. PRIOR ART
Figure 3:
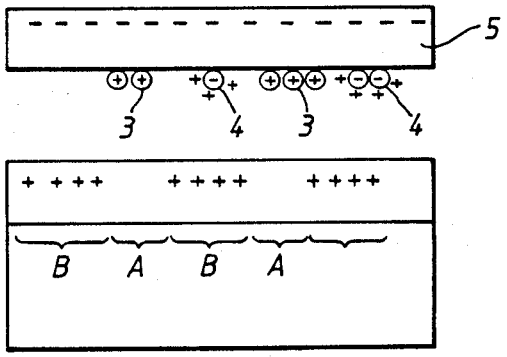
FIG. 3. PRIOR ART
Figure 4:
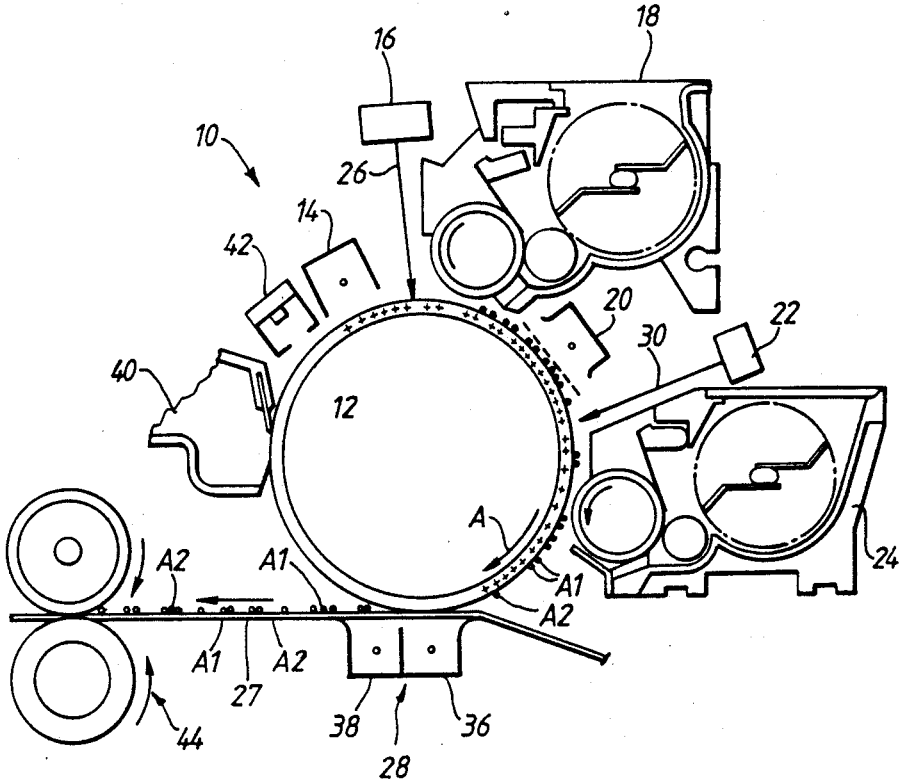
FIG. 4 is a schematic view showing the arrangement of an image forming section of an image forming apparatus according to the present invention.

In FIG. 4, a recording apparatus 10 as an image forming apparatus according to an embodiment of the present invention is shown. Recording apparatus 10 includes a photosensitive drum 12 as an image carrier which is made of selenium-based photoconductive material and is rotatable in the direction of an arrow A. Around the periphery of photosensitive drum 12, there are provided a first charger 14, a first exposure unit 16, a first developing unit 18, a second charger 20, a second exposure unit 22 and a second developing unit 24, in that order going in the direction of photosensitive drum 12 rotation.

First charger 14 charges the surface of photosensitive drum 12 and an electrostatic latent image is formed in charged portions by irradiation with a laser beam 26 from exposure unit 16 in accordane with the image formation that is to be recorded. First developing unit 18 contains a nonmagnetic black toner not including carrier particles, that is described later, and effects development by adhering the black toner to an electrostatic latent image as a first color.

A scorotron charger which permits control of the amount and the area of charge on the photosensitive drum surface is used as second charger 20. A noncontact development process is employed in second developing unit 24, which contains a nonmagnetic toner. The toner in second developing unit 24 is blue.

After second developing unit 24, a transfer unit 28 for transferring developed images onto a white sheet 27 are provided at the periphery of photsensitive drum 12. Transfer unit 28 comprises a transfer charger 36 which charges the rear surface of sheet 27 with a negative charge so as to attract toner onto sheet 27 and a separation charger 38 which serves to effect electrostatic separation of the sheet from photosensitive drum 12 following transfer.

At the periphery of photosensitive drum 12 between transfer unit 28 and first charger 14, there are a cleaning unit 40 which removes toner which has failed to be transferred and remains on photosensitive drum 12 and a charge removal lamp 42 which removes residual potential of photosensitive drum 12. The unit arranged on the transporting path along which sheet 27 is forwarded following transfer is a fixing unit 44. Fixing unit 44 fixes the transferred toner image onto the sheet.

Next, the operation of this embodiment will be described. Photosensitive drum 12 is rotated in the direction of arrow A and first its surface is uniformly charged to about +600 V (volts) by first charger 14. Next, exposure unit 16 effects exposure by laser beam 26 irradiation of the surface of photosensitive drum 12 in correspondence to the black portions of the information that is to be recorded. When this is done, a potential of about 100 V is produced at exposed portions. In other words, first laser beam 26 forms so-called first potential well portions.

Next, development is effected by the black toner being supplied from first developing unit 18 and being electrostatically adhered to the potential well portions as image portions corresponding to an electrostatic latent image. The development here is so-called reversal development in which positively charged black toner adheres to first potential well portions.

After the electrostatic latent image has been developed by the black toner, the surface potential of photosensitive drum 12 is made uniform at about +1,000 V by second charger 20. This charging results in the background potential, i.e., the potential of portions that have not been exposed by first exposure unit 16, being made about 1,000 V and the potential of portions in which the first potential well portions is formed being made about 950 V.

Next, an electrostatic latent image is formed in correspondence to recorded information that is to be made blue by irradiation with a second laser beam 30 from second exposure unit 22. In this process, only image portions are exposed and second potential well portions at a potential of about 100 V are formed. Then, the blue toner is adhered to the second potential well portions corresponding to the electrostatic latent image by second developing unit 24, eo effecting reversal development like the development effected by first developing unit 18. The wiped off of the black toner that is already adhering and adhesion of the blue toner on top of the black toner are prevented since second developing unit 24 effects development by a noncontact developing process. The noncontact developing process is described in the disclosure "High-Speed Color Laser Printing Process" (M. Kohyama et al.) explained in the Discussion of Background.

After formation of the first-color toner image and the second-color image, the two types of the first color toner and the second color toner are simultaneously transferred by transfer unit 28 onto sheet 27 transported to this unit. At this transfer unit 28, transfer charger 36 charges sheet 27 transported in synchronism with photosensitive drum 12 by supplying corona ions that are of opposite polarity to the charge carried on photosensitive drum 12, i.e., negative corona ions, to the rear surface of sheet 27. As this establishes an electric field between photosensitive drum 12 and sheet 27, the toner images are transferred onto sheet 27 by electrostatic attraction.

Sheet 27, on which each color toner image has been transferred, is electrostatically peeled from photosensitive drum 12 by the operation of separation charger 38. Then sheet 27 is conveyed to fixing unit 44, and transferred images are heat-fixed on sheet 27. Following transfer of the toner image, photosensitive drum 12 is electrically discharged by charge removal lamp 42 after any residual toner has been removed from the surface of the drum 12 by cleaning unit 40, so that the drum 12 is returned to its initial condition.

There now follows a description of the first and second developing units 18 and 24. As these units have generally the same configuration, apart from the fact that the colors of the colored particles in the toner (developer) they hold are different, only second developing unit 24 will be described and a description of first developing unit 18 will be dispensed with.

Figure 5:
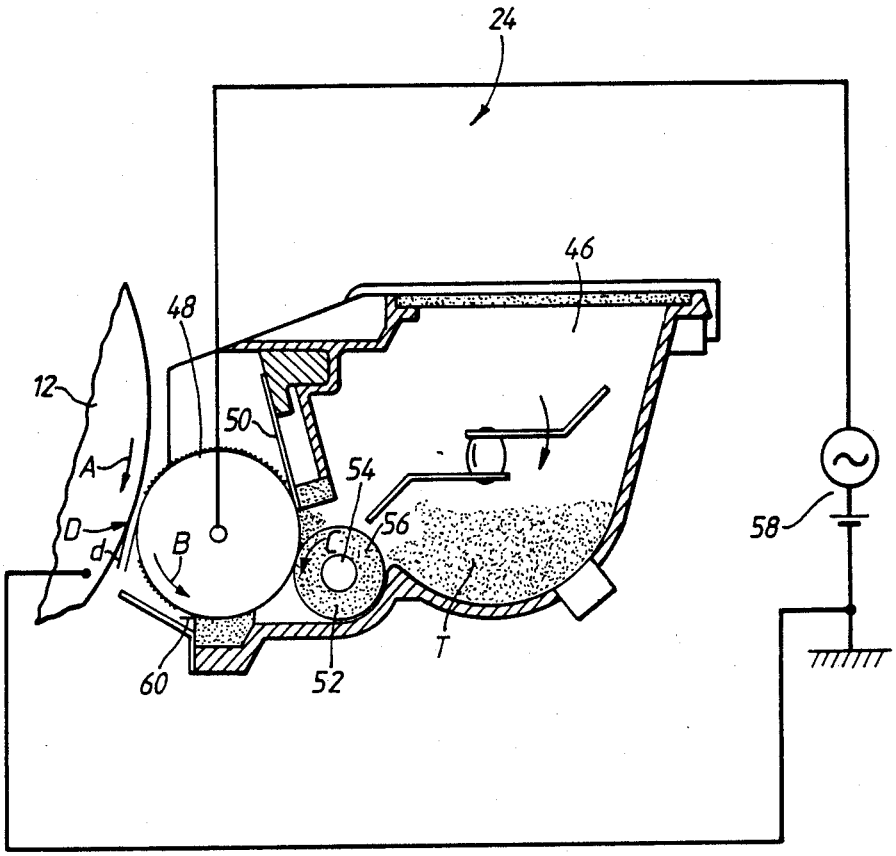
FIG. 5 is a schematic cross-sectional view of a developing unit used in the image forming apparatus shown in FIG. 4.

As shown in FIG. 5, developing unit 24 comprises a hopper 46 holding developer T and a developing roller 48 which is rotatable in the direction of arrow B and supplies toner from hopper 46 towards photosensitive drum 12. The developer used is a nonmagnetic toner not, including carrier particles, constituted by resin and a coloring agent. The peripheral surface of developing roller 48 is made rough so as to facilitate friction charging and transport of the developer. The free end of a flexible blade 50, which extends towards hopper 46, is in pressure contact with the peripheral surface of developing roller 48. As the free end of flexible blade 50 extends in a direction that is opposed to the direction of rotation of developing roller 48, the wedge-shaped space defined between flexible blade 50 and the surface of developing roller 48 is reduced, accumulation of toner T in this portion is prevented. As a result, the toner coating action and toner charging action of flexible blade 50 are performed uniformly, and consequently there is stable formation of a thin film of toner. Flexible blade 50 may be of any material as long as it is flexible material. Preferably a plate of stainless steel or phospho bronze, etc. is used. The plate thickness is preferably about 0.1–0.4 mm and the blade is disposed so that it forms a nip width with respect to developing roller 48, with its center constituting the point of pressure against developing roller 48. The press point in this case is a point tht is about 1–5 mm from the free end of flexible blade 50.

Hopper 46 has provided therein a supply roller 52 which contacts and serves to supply developer to developing roller 48, and is arranged so that it rotates in the opposite direction C to the direction of rotation B of developing roller 48. Supply roller 52 has a roller 56 of polyurethane foam provided on a rotation shaft 54.

Developing roller 48 is connected to a bias power supply 58, which supplies a superimpoased DC voltage and AC voltage. Underneath developing roller 48, a recovery blade 60 is disposed in pressure contact with developing roller 48 to recover toner remaining on developing roller 48 into hopper 46. Recover blade 60 is made of thin plate material such as metal, plastic or rubber, etc., and serves to prevent outflow of toner T from hopper 46, as well as recovering toner that adheres to the developing roller.

Developing roller 48 faces photosensitive drum 12 and is separated therefrom by a gap d. Photosensitive drum 12 is installed so that it rotates in the direction of arrow A and is grounded. Gap d is made about 0.1–0.5 mm. Photosensitive drum 12 is manufactured by forming a photosensitive layer on an aluminium drum surface.

There now follows a description of the developer (toner) that is used in developing units 18 and 24.

The developer comprises colored particles and additive particles. Each additive particle has a color substantially the same as the color of the image bearing medium onto which toner images are formed by transferring the developed image from photosensitive drum 12, or each additive particle is colorless and transparent. If a white sheet is used as the image bearing medium, white particles or colorless transparent particles are used as additive particles. If a blue sheet is used as the image bearing medium, blue particles or colorless transparent particles are used as additive particles.

The colored particles used in the developer preferably have a glass transition point of 50° C. or more and a softening point of 110° C. or more but less than 160° C. If the glass transition point is less than 50° C., the storage stability of the colored particle is deteriorated. If the softening point is less than 110° C., so-called offset or fusion to the fixing roller during fixing is liable to occur, and if the softening point exceeds 160° C. fixing becomes difficult.

The additive particles are preferably particles that can be charged with a polarity opposite to that of the colored particles. In this case, the additive particles become charged with a charge of reverse polarity during friction-charging of the colored particles, and thereby serve to promote charging of the colored particles and also to help the charge to be firmly held by the colored particles. Also, since the colored particles are frictionally charged through contact with additive particles before and during the time that they are pressed against a developer bearing member by a toner layer forming element, charging is effected more fully and more surely than it is in friction-charging by the toner layer forming element alone.

The amount of additive particles is preferably about 0.05–10 wt % (percent by weight) relative to the colored particles. If the amount added is less than 0.05 wt %, a satisfactory preliminary charging effect through friction with the colored particles cannot be achieved. If the amount is more than 10 wt % the relative concentration of the colored particles is reduced, resulting in lower image desnity.

The mean particle diameter of the additive particles is 1/5 or less of the mean particle diameter of the colored particles and is preferably about 0.5 to 5 μm. If the mean diameter of the additive particle exceeds 1/5, the mean diameter of the colored particles, the result is lower image density. Also, when the diameter of the additive particles is thus made small, the particles enter between the fibers of the image bearing sheet and so become less apparent.

It is acceptable to add charge regulators such as metalcontaining dye, nigrosine material or polyamine material, etc. to the colored particles for the purpose of controlling their charge. Also, wax may be added in order to improve offset resistance characteristics.

Also, if required, in order to improve the fluidity and agglomeration resistance of the colored particles (toner), second additive particles in the form of colloidal silica or similar fine colloidal particles that have been made hydrophobic and ahve the same polarity as the toner may be added within a range such that no adverse effects are had on the amount of charge of the toner.

Known material may be employed as the resin used in the colored particles.

Examples of such material include polystyrene, polystyrene - butadiene copolymers, styrene - acryl copolymers and similar styrene copolymers, polyethylene, polyethylene - vinyl acetate copolymers, polyethylene - vinyl alcohol copolymers and similar ethylene copolymers, phenol resin, polyamide resin, polyester resin, maleic acid resin, polymethacrylate, polyacrylic acid, polyvinyl butyral, so-called petroleum resins such as aliphatic or alicyclic hydrocarbon resin or aromatic hydrocarbons, etc., chlorinated paraffin, low molecular weight polyethylene, low molecular weight polypropylene, wax, etc. and mixtures of such materials.

The coloring agent used in the colored particles may be a known coloring agent such as, e.g., carbon black, fast yellow G, benzidine yellow, pigment yellow, indofast, orange, irgadine red, carmine FB, permanent bordeaux FRR, pigment orange R, lithol red 2G, lake red C, rhodamine FB, rhodamine B lake, phtalocyanine blue, pigment blue, brilliant green B, phthalocyanine green or quinacridone.

Known material that is effectively white or colorless is used for the additive particles.

For example, use may be made of material such as aluminium oxide, titanium oxide, silicon oxide, zinc oxide, magnesium oxide, barium titanate, calcium titanate, calcium oxide, tin oxide, indium oxide, inorganic oxides which have been surface treated with silicone oil or a coupling agent such as a silane coupling agent or titanium coupling agent, etc., polystyrene, polystyrene - butadine copolymer, styrene - acryl copolymer or similar styrene copolymers, polyethylene, ethylene copolymers, polymethyl methacrylate and similar aliphatic or alicyclic copolymers, finely powdered silicone resin or Teflon, etc. or fine powder of resin that has been surface treated with a coupling agent or silicone oil, etc.

Figure 6:
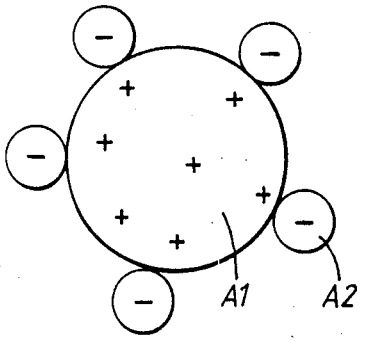
FIG. 6 is a shcematic view showing a composition of toner used in the developing unit shown in FIG. 5.

Toner used in this embodiment is in the form shown in FIG. 6. As shown in FIG. 6, negatively charged additive particle A2 adhere to the periphery of a positively charged colored particle A1 constituting a sort of nucleus. Colored particle A1 and additive particles A2 serve to maintain or strengthen the value of one anothers' charge.

Figure 7:
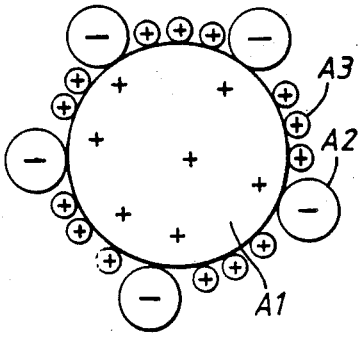
FIG. 7 is a schematic view showing another composition of toner used in the developing unit shown in FIG. 5.

Toner used in another embodiment is in the form shown in FIG. 7. As shown in FIG. 7, second additive particles A3 are added to colored particle A1 and additive particles A2. In this case, the second additive particles A3 serve to improve the fluidity and agglomeration resistance of the toner and are constituted by colloidal silica or similar fine colloidal particles which have been made hydrophobic and have the same polarity as the toner. The second additive particles A3 may be added to an amount such that they have no adverse effect on the toner charge. The particle diameter of second additive particles A3 is smaller than that of additive particles A2. As a result, a great attractive force (Van der Waals attraction, electrostatic force, etc.) is generated between colored particles A1 and second additive particles A3, and between additive particles A2 and second additive particles A3. Most of second additive particles A3 are attracted to colored particles A1, while the remainder of second additive particles A3 are attracted to additive particles A2. The second additive particles A3 may have the same color as colored particles A1 such that they have no adverse effect on the developed color image. If required, they may be attracted and made difficult to separate by heat treatment to cuase fusion. The fine colloidal particles here are preferably about 0.5 μm or less so as to improve their stability as colloidal particles.

Figure 8:
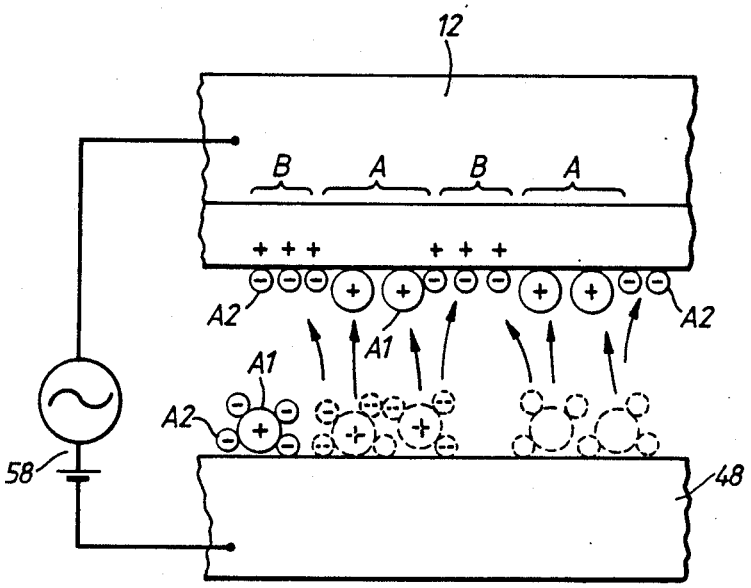
FIG. 8 is a schematic view explanatorily showing the developing mechanism using the toner shown in FIG. 6.

As an AC voltage is imposed on developing roller 48 while it is in a position facing photosensitive drum 12, developer repeatedly performs a reciprocal movement in which it moves away from and then returns towards developing roller 48, and during this process developer becomes adhered to an electrostatic latent image formed on photosensitive drum 12. The toner action in this process will be explained with reference to FIG. 8 showing reversal development.

Colored particles A1 constituting the toner and additive particles A2 are subjected to vibrational force under the effects of the AC field and since they are of different polarity they are separated and colored particles A1 transfer and adhere to image portions A, while additive particles A2 transfer and adhere to non-image portions B. Since things are arranged so that the charge of the different particles A1 and A2 combined is a charge of predetermined polarity (positive in this embodiment), the amount of toner that adheres to non-image portions B is kept to a minimum even if colored particles A1 and additive particles A2 do not separate. Thus, production of a good image is ensured even in this case.

If the toner contains as admixture of second additive particles A3 with colored particles A1 and additive particles A2 as shown in FIG. 7, the second additive particles A3 remain adhered to colored particles A1 and perform almost same action as colored particles A1.

Since colored particles A1 and additive particles A2 carry charges of mutually opposite polarity, there is selective electrostatic adhesion of only colored particles A1 to the image portions of the electrostatic latent image and a positive action whereby only additive paticles A2 are adhered to non-image portions.

The developed image produced by first developing unit 18 is charged to a positive polarity by second charger 20, and when this is done additive particles adhering to nonimage portions are also charged to a positive polarity. Consequently, when the developed image is transferred to sheet 27 by transfer unit 28, additive particles A2 are transferred together with colored particles A1 onto the sheet, since this sheet is negatively charged. However, the additive particles have a color the same as the color of the sheet on which the developed image formed by transferring the developed image from photosensitive drum 12, or the additive particles are colorless and tansparent and so even if they are transferred onto the sheet they do not appear as background fogging, i.e., one is not aware of them.

The colored particles and additive particles may not always separate at the time of development but even if the additive particles remain adhered to the colored particles and take part in development, this does not cause unclearness of the image, since the additive particles are white the same as the color of the sheet, or colorless and transparent.

TEST EXAMPLE 1

93 parts by weight of styrene - n butyl methacrylate copolymer (glass tansition point Tg: 66° C., average molecular weight $\overline{MW}$99000, softening point 123° C.) as a colored particle resin material and a4 parts by weight of carbon black (trade name: MA-100; manufactured by Mitsubishi Kasei) as a coloring agent with wax (trade name: 660P; manufactured by Sanyo Kasei) were kneaded for about 1 hour in a pressurisation type kneader. The mixture was cooled, and rough ground in a hammer mill and then fine ground in a jet mill. The resulting powder was classified by an air classification procedure to give a set of colored particles. The 50% weight average particle diameter in the set of colored particles was 12.8 μm and as measured by the blowoff method, the amount of charge produced by friction was minus 28.5 μc/g.

The additive particles employed were constituted by surface treated silica (50% weight average particle diameter was 12 milli μm, the amount of charge was plus 310 μc/g).

A single-component type developer was produced by mixing 100 parts by weight of the above-noted set of colored particles and 1 part by weight of additive particles for about 1 hour in a V type blender.

This developer was loaded into a developing unit of the same type as developing unit 18 shown in FIG. 4. This unit was mounted on a copying maching (trade name: 3110; manufactured by Toshiba KK) and a duplicate image of an original document was formed on a sheet.

The result was the production of a clear image that had an image density of 1.35 and was free of background fogging. When images were produced by the same procedure in a high temperature, high humidity environment (temperature 30° C., humidity 85%), no background fogging or lowering of image density was observed, but clear images with good transfer efficiency were produced. An image density value of about 1.3 was about the same as the denisty of the original document, images being fainter than the original document at values lower than this and denser at higher values.

When the images were fixed by a heat roll fixing unit, both fixing and offset were good in the range 170°–220° C. and images of the same quality were obtained even after 10,000 copies.

When duplicate images were produced in the same way as in Test Example 1 but using only the colored particles produced in Test Example 1, i.e., not using additive particles, the image density was 1.1 and background fogging occurred in many places.

TEST EXAMPLE 2

Colored particles (50% average particle diameter was 13.1 μm, the amount of charge was plus 32.8 μc/g) were produced by a process in which styrene - n - butyl acrylate - 2 ethylaminoethyl methacrylate copolymer (the glass transition point Tg was 67° C., the average molecular weight $\overline{MW}$ was 280,000, the softening point was 135° C.) was used as the colored particle resin material, but which was otherwise the same as in Test Example 1. The additive particles employed were constituted by using polymethacrylate (the average particel diameter was 0.4 μm, the amount of charge was minus 500 μc/g). Then, a single-component type developer was produced in the same way as in Test Example 1. This developer was used to form images in the same way as in Test Example 1.

The results were that, as in Test Example 1, clear images were obtained that had good image density and were free of background fogging.

Although the embodiment above was described as using developers of two colors, the invention is not limited to this but the same advantages may be achieved in a multicolor electrostatic recording apparatus in which development with three or four colors is effected.

Various other modifications could be made in the present invention without departing from the scope or spirit of the following claims.

What is claimed is:

1. An image forming apparatus, comprising:

means for forming a first electrostatic latent image having two distinct portions on an image carrier, means for developing the first electrostatic latent image into a first visible image on the image carrier, means for charging the image carrier with the first visible image thereon, means for forming a second electrostatic latent image on the image carrier, means for developing the second electrostatic latent image into a second visible image on the image carrier, and means for transferring the first and second visible images from the image carrier onto an image bearing medium, wherein the first developing means includes:

a developer including colored particles having a prescribed polarity and additive particles having a polarity opposite to the prescribed polarity of the colored particles to adhere onto the periphery of the colored particles, the additive particles having a color substantially the same as the image bearing medium or being substantially colorless and transparent; and electric field generating means for tansferring the colored particles onto one of the two distinct portions of the first electrostatic latent image and the additive particles separated from the colored particles onto the other of the two distinct portions of the first electrostatic latent image.

2. The apparatus of claim 1 wherein the developer has an overall polarity the same as the prescribed polarity of the colored particles.

3. The apparatus of claim 1 wherein the developer further includs second additive particles adhered onto the periphery of the colored particles for improving the fluidity of the developer.

4. The apparatus of claim 3 wherein the mean diameter of the second additive particles is smaller than the mean diameter of the first additive particles.

5. The apparatus of claim 4 wherein the second additive particles have a color substantially the same as the image bearing medium, or are substantially colorless and transparent.

6. The apparatus of claim 1 wherein the amount of the additive particles in the developer is about 0.05–10 wt % (percent by weight) relative to the colored particles.

7. The apparatus of claim 1 wherein the mean particle diameter of the additive particles is 1/5 or less of the mean particle diameter of the colored particles.

8. A developer for developing an electrostatic latent image having two distinct portions into a visible image on an image carrier, comprising:

a plurality of colored particles having a prescribed polarity; and a plurality of additive particles having a polarity opposite the prescribed polarity of the colored particles and being smaller than the colored particles, to adhere to the periphery of the colored particles, and having substantially the same color as the image bearing sheet or being substantially colorless and transparent, the additive particles being readily separated from the colored particles to deposit onto one of the two distinct portions of the electrostatic latent image on the image carrier by an electric developing field.

9. An image forming apparatus comprising:

means for forming a first electrostatic latent image having two distinct portions on an image carrier;

means for developing the first electrostatic latent image into a first visible image on the image carrier, the first developing means including a developer including colored particles having a prescribed polarity and additive particles having a polarity opposite to the prescribed polarity of th colored particles to adhere onto the peripheries of the colored particles, the additive particles having a color substantially the same as the image bearing medium or being substantially colorless and transparent, and electric field generating means for transferring the colored particles onto one of the two distinct portions of the first electrostatic latent image and the additive particles, separated from the colored particles, onto the other of the two distinct portions of the first electrostatic latent image;

means for charging the image carrier with the first visible image thereon;

means for forming a second electrostatic latent image on the image carrier;

means for developing the second electrostatic latent image into a second visible image on the image carrier; and means for transferring the first and second visible images from the image carrier onto an image bearing medium.

* * * * *